US005303515A

United States Patent [19]

Etcheparre et al.

[11] Patent Number: 5,303,515

[45] Date of Patent: Apr. 19, 1994

[54] METHOD AND DEVICE FOR AUTOMATICALLY SHARPENING CUTTING BLADES

[75] Inventors: Jean Etcheparre; Bernard Etcheparre, both of Bordeaux, France

[73] Assignee: Lectra Systems S.A., Cestas Bordeaux, France

[21] Appl. No.: 963,913

[22] Filed: Oct. 20, 1992

Related U.S. Application Data

[63] Continuation-in-part of Ser. No. 888,402, May 21, 1992, abandoned, which is a continuation of Ser. No. 579,149, Sep. 6, 1990, abandoned.

[30] Foreign Application Priority Data

Sep. 15, 1989 [FR] France ..... 89 12147

[51] Int. Cl.[5] ..... B26D 7/12

[52] U.S. Cl. ..... 51/285; 83/174; 51/210; 51/248; 51/249

[58] Field of Search ..... 83/13, 174; 30/139, 30/275; 51/205 WG, 210, 241 R, 241 G, 247, 248, 95 R, 285, 249, 250

[56] References Cited

U.S. PATENT DOCUMENTS

| | | | |
|---|---|---|---|
| 2,033,939 | 3/1936 | Jeppsson | 51/248 X |
| 2,129,632 | 9/1938 | Segal | 51/248 |
| 2,171,604 | 9/1939 | Segal | 51/249 |
| 2,186,507 | 1/1940 | Trantino | 51/248 |
| 2,236,038 | 3/1941 | Silberstang | 51/250 |
| 3,181,406 | 5/1965 | Sayles | 83/174 |
| 3,233,371 | 2/1966 | Stucker | 51/249 |
| 3,821,915 | 7/1974 | Larrable | 83/174 |
| 4,201,101 | 5/1980 | Gerber | 83/174 |
| 4,442,599 | 4/1984 | Clark | 83/174 X |
| 4,723,375 | 2/1988 | Linden | 51/210 X |

FOREIGN PATENT DOCUMENTS 1016574 11/1952 France .

*Primary Examiner*—Hien H. Phan
*Assistant Examiner*—Clark F. Dexter
*Attorney, Agent, or Firm*—Fulwider Patton Lee & Utecht

[57] ABSTRACT

The device for sharpening a cutting blade presenting a sharp edge includes at least one grinding wheel provided at least on the surface with abrasive material. The grinding wheel has a cylindrical body presenting a V-sectioned peripheral groove, and is mounted to rotate freely about an axis contained in a plane generally parallel to the sharp edge of the blade and perpendicular to the median plane of the blade, with the axis being inclined by a predetermined angle with respect to the normal to the median plane of the blade. The sharpening device is further constructed to place the blade and the grinding wheel in contact and to provide for relative displacement of the blade and the grinding wheel in a direction parallel to the sharp edge of the blade.

9 Claims, 5 Drawing Sheets

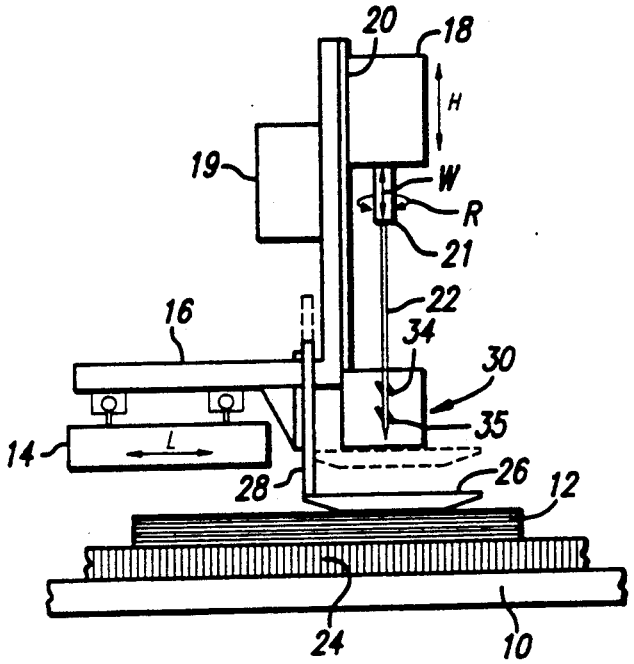
FIG. 1
FIG. 2
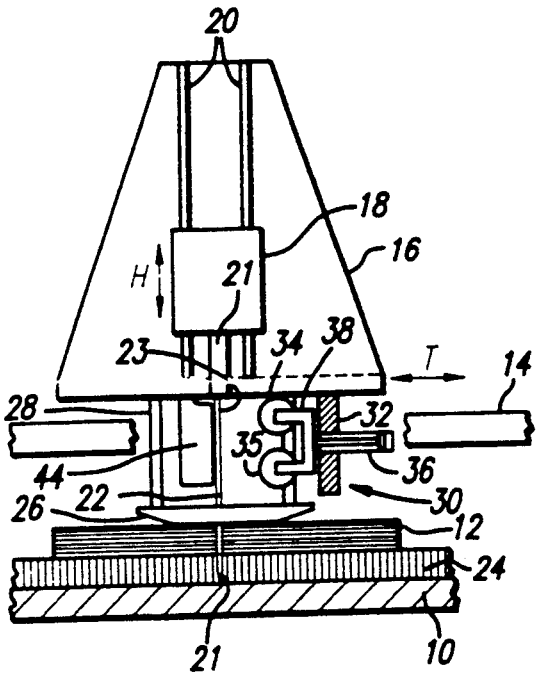
FIG. 3
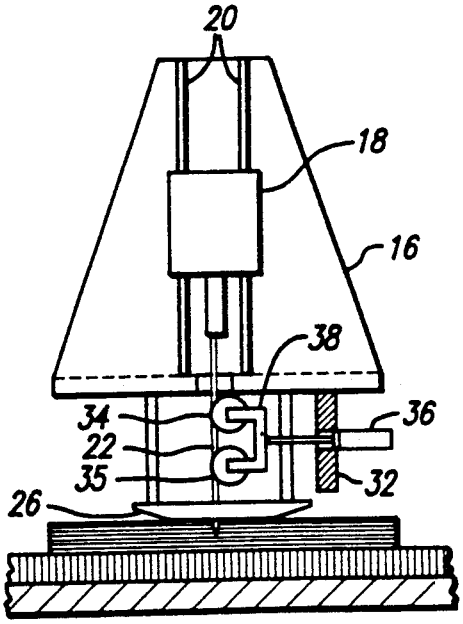

METHOD AND DEVICE FOR AUTOMATICALLY SHARPENING CUTTING BLADES

RELATED APPLICATIONS

This is a continuation-in-part of copending Ser. No. 07/888,402, filed May 21, 1992, which was a continuation of Ser. No. 07/579,149, filed Sep. 6, 1990, both applications now abandoned.

BACKGROUND OF THE INVENTION

Field of the Invention

The present invention relates to a method and device for automatically sharpening cutting blades.

SUMMARY OF THE INVENTION

It is known to use automatic cutting machines for cutting stacks of materials in sheet form, such as fabric for example, in the garment industry. These machines are generally constituted by a cutting table on which is deposited the stack of material, or mattress; by a mobile assembly consisting of a beam disposed transversely above the table and sliding on longitudinal guides; by a cutting carriage sliding along the beam; by a cutting head fixed on the cutting carriage. The different mobile elements are motorized by servo-motors for example, which are controlled by a numerical control unit. The cutting head may thus be displaced to any point of the cutting table, along pre-established paths. The cutting head generally consists of a mechanism for vertically vibrating a sharpened blade, which mechanism may rise and descend so as to cause the blade to penetrate or exit at the desired spot in the stack of material. The blade may rotate about its vertical axis. Rotation is servo-controlled so that the blade always remains correctly oriented with respect to the path. In order that the blade may cut all the folds of the stack of material, the blade must penetrate into the cutting table, which therefore comprises a coating to that end.

As cutting proceeds, the blade progressively loses its cutting power. It is therefore necessary to resharpen it regularly, the time between two sharpenings essentially depending on the abrasive character of the material cut. Such sharpening must be rendered automatic in order not to disturb the automatic operating cycle of the cutting machine. To that end, several solutions exist, of which abrasive strips or small rotating cylindrical grinding wheels have been employed for a very long time on manual electric shears used in the garment industry (called "tip-top"). The performance of these sharpeners is relatively limited. More particularly, their dimensions are too large and their speed of sharpening too slow. They also require a motorization of the abrasive element, whether it be a grinding wheel or a strip, which complicates the mechanism.

The present invention has for its object a sharpening process and device overcoming drawbacks of conventional devices, and provides the following advantages:

- no need for motorization
- rapid sharpening
- reduced dimensions
- automatic compensation of wear
- excellent quality of sharpening
- no precise adjustment to be made.

SUMMARY OF THE INVENTION

According to the invention, the sharpening device for an elongated cutting blade presenting a sharp edge comprises a grinding wheel provided on the surface with abrasive material, the grinding wheel having a cylindrical body presenting a V-sectioned peripheral groove, the grinding wheel being mounted to rotate freely about an axis TT contained in a plane generally parallel to the edge of the blade and perpendicular to the median plane CXZ of the blade, and the axis inclined by a predetermined angle P with respect to the normal CY to the median plane of the blade, the sharpening device further comprising means for placing the blade and the grinding wheel in contact and means for relative displacement of the blade and the grinding wheel in a direction parallel to the edge of the blade.

In order to create the relative movement of the blade with respect to the grinding wheel, there are two modi operandi. The first consists in maintaining the blade fixed, in a high position, and in displacing the grinding wheel, firstly in a horizontal movement to come into contact with the blade and then a vertical movement to displace it along the sharp edge of the blade. An automatic cycle may be effected, allowing several passages until correct sharpening is obtained. Contrary to the first, the second mode consists in maintaining the grinding wheel fixed in height and in displacing the blade in front of the grinding wheel. Displacement of the blade may result in particular from the longitudinal vibration of the blade. This solution has the advantage of simplifying the sharpening device by eliminating the need for a member for producing the vertical displacement of the grinding wheel with respect to the blade. One or the other solution will be chosen as a function of the design of the cutting head assembly.

Sharpening is effected in accordance with the following principle: the sharp edge of the blade is brought into contact with the outer edges of the groove of the grinding wheel. Due to the inclination of the grinding wheel, contacts are made on the two opposite sides of the blade. Relative displacement between the blade and the grinding wheel creates, by friction, rotation of the grinding wheel. The abrasive grain structure of the grinding wheel then machines the blade along inclined paths with respect to the sharp edge, hence sharpening the blade. As sharpening continues, the blade becomes worn and advances towards the inside of the groove of the grinding wheel.

The dimensions of the grinding wheel depend on several factors, of which the principal ones are as follows:

- angle of sharpening of the cutting blade
- length of the zone to be sharpened
- maximum dimensions not to be exceeded
- amplitude of the relative vertical movement of the grinding wheel and of the blade.

All the other parameters follow from one another. It will be observed that an infinite number of solutions exist. The solution retained will be a compromise respecting the different parameters.

The sharpening of a cutting blade mounted in rotation about its longitudinal axis raises another technical problem.

In fact, during cutting, the blade makes a rotation about its vertical axis imposed by the blade-holder unit, so that the direction of the sharp edge of the blade at the moment of sharpening cannot be foreseen; the position of the grinding wheel with respect to that of the blade must therefore be rectified at each sharpening.

It is a further object of the present invention to solve this problem by simultaneously imposing on the grinding wheel the same movements of rotation as on the blade.

This object is attained according to the invention by a grinding wheel fixed by means of a horizontal spindle on a plate mounted for rotation with the blade so that the groove of the grinding wheel is constantly opposite the sharp edge of the blade.

BRIEF DESCRIPTION OF THE DRAWINGS

The invention will be more readily understood upon reading the following description with reference to the accompanying drawings, in which:

FIG. 1 is a side view of a cutting machine equipped with the sharpening device according to the present invention.

FIG. 2 is a lateral view similar to that of FIG. 2, illustrating the process of sharpening.

FIG. 3 is a lateral view similar to that of FIG. 2, illustrating a variant of the sharpening device.

DETAILED DESCRIPTION OF THE PREFERRED EMBODIMENTS

Figure 5:
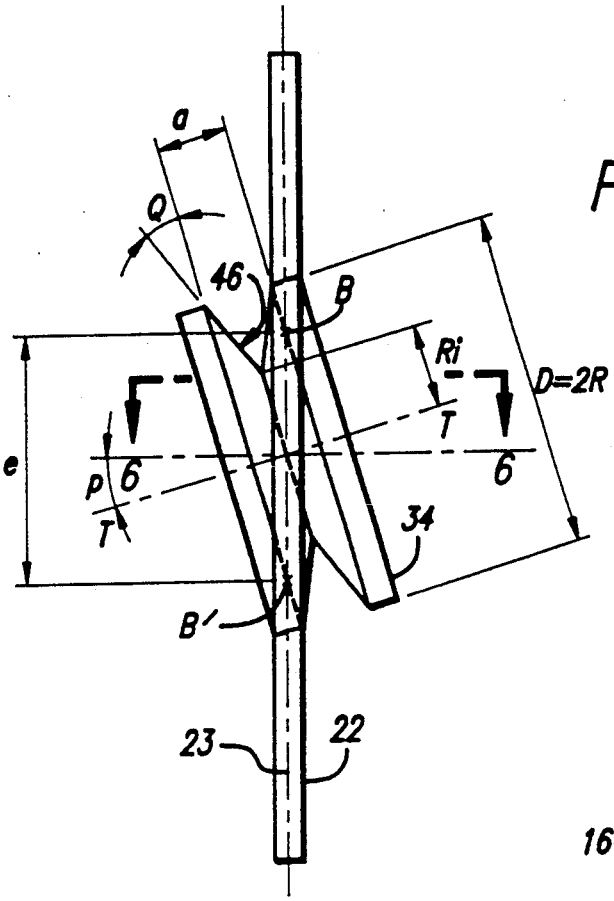
FIG. 5 is a front view of a blade part and of a grinding wheel for sharpening according to the invention.

Referring now to the drawings, the cutting machine illustrated in FIG. 1 comprises a fixed table 10, disposed on a frame (not shown) and adapted to receive a stack of materials in sheet form, or mattress 12, with a view to cutting it along a predetermined line.

Above the table is disposed a beam 14, mounted for longitudinal displacement over table 10 and driven by means (not shown) in a right-left direction in FIG. 1, symbolized by arrow L.

On beam 14 is mounted a carriage 16 which moves along the beam, with the aid of means (not shown), in transverse direction with respect to the table, in the forward-rearward direction in FIG. 1, or right-left direction in FIG. 2, symbolized by arrow T. A blade-holder unit 18 is mounted laterally on the carriage 16, via vertical displacement means 20, in order to be able to move vertically on the carriage, therefore with respect to table 10, as illustrated by arrow H in the Figure, by any drive means 19 as is well known in the art.

The blade-holder unit contains a member 21 for gripping a vertical cutting blade 22, means for imparting to the blade a vibrating movement in the vertical sense symbolized by double arrow W, and means for imparting to the blade a movement of rotation about a vertical axis as symbolized by arrow R.

The object of such rotation of the blade is to maintain the sharp edge of the blade constantly oriented along the tangent to the path imposed by the longitudinal and transverse drive members associated with the beam 14 and with carriage 16 respectively.

The upper face of the table is covered with a layer 24 of supple, penetrable material, for example a coir mat, that the tip of the blade 22 may penetrate in order to enable the whole thickness of the stack of sheet material 12 to be cut.

Beneath carriage 16 is disposed a presser foot 26 mobile vertically between a raised position, illustrated in broken lines, at a certain distance from the table 10 to allow the material 12 to be positioned on or removed from table 10, and a lowered position in contact with the material placed on the table.

The presser foot 26 has a double function. The first function is to press the stack of material 12 around the blade 22 to prevent the stack from following the movements of vertical vibration of the blade. The second function is to correctly guide the blade 22 as close as possible to the stack 12 so as to avoid bending of the blade 22 due to the horizontal cutting efforts.

Displacement of the presser foot 26 between its raised and lowered positions is ensured by guides 28 and a drive member (not shown).

To allow simple and rapid sharpening of the blade without notably interrupting the cutting process, it is provided according to the invention to mount on the carriage 16 a sharpening device 30 constituted as follows:

A plate 32 is fixed to the carriage 16 on one side of the blade 22. A grinding wheel 34 for sharpening is mounted for horizontal movement opposite blade 22 and may be moved away or nearer it by a drive member, for example a jack 36 as shown.

In this embodiment, two grinding wheels 34, 35 for sharpening the blade are provided, disposed one above the other and mounted idly on a bifurcated support 38 at the end of the rod of jack 36 in order to ensure that the grinding wheels 34, 35 are both correctly in contact with blade 22.

The structure and arrangement of the grinding wheels will be described in detail hereinafter. As illustrated in FIG. 3, blade 22 is sharpened at regular intervals in the following manner:

- the longitudinal and transverse displacements of beam 14 and of carriage 16 are stopped,
- the vertical vibration (W) of blade 22 is stopped,
- the blade 22 is pivoted (R) until the sharp edge 23 thereof is opposite the grinding wheels 34, 35 for sharpening.

This operation is all the more difficult as the material is hard and thick.

- the grinding wheels 34, 35 are brought into contact with the sharp edge 23 of blade 22,
- blade 22 is caused to effect at least one vertical rising stroke (H) of desired amplitude, by raising the blade-holder unit 18 with respect to carriage 16, in order to sharpen blade 22 over a desired length from its tip 21,
- the grinding wheels 34, 35 are moved away from blade 22,
- the blade is re-oriented in its initial position,
- blade 22 is re-lowered in the material 12 to be cut,
- vertical vibration (W) of blade is resumed, and the longitudinal and transverse displacements of beam 14 and of carriage 16 are resumed.

Figure 4:
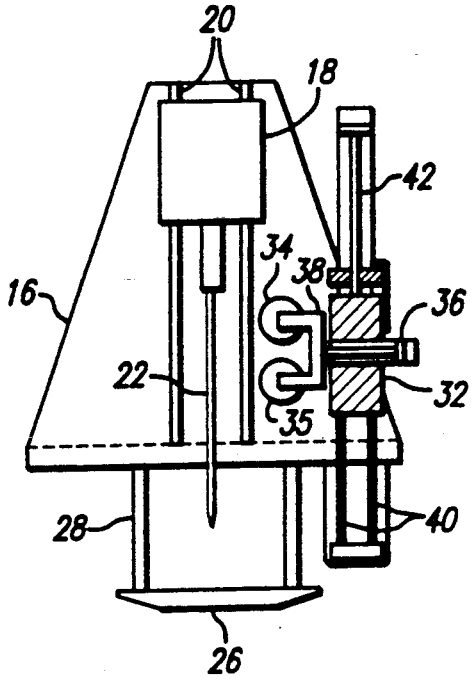
FIG. 4 is a lateral view similar to that of FIG. 2, illustrating a variant of the sharpening device.
Figure 6:
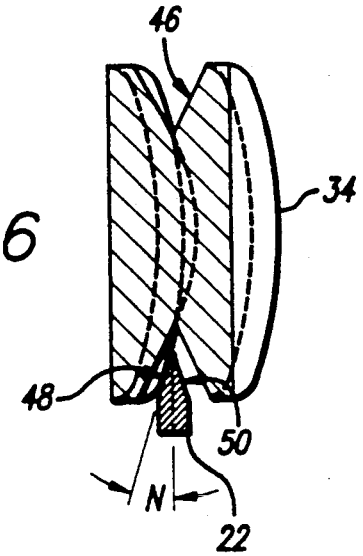
FIG. 6 is a view in horizontal section taken along line 6—6 of FIG. 5.

As illustrated in FIG. 4, it may be provided in a variant embodiment that blade 22 remains fixed during sharpening and that grinding wheels 34, 35 move vertically.

To that end, plate 32 and jack 36 for displacement of grinding wheels 34, 35 are mounted for movement along vertical guides 40 of carriage 16, under control of a drive member, for example another jack 42.

When blades 22 are relatively fine and capable of bending considerably upon contact with grinding wheels 34, 35, it will advantageously be provided to dispose against the blade and opposite the grinding wheels, a rear stop 44 against which the blade abuts, which prevents the blade from bending.

As illustrated in FIG. 2, the rear stop may be a simple stop with flat bearing surface made of wear-resistant material, against which the edge of blade 22 opposite the sharp edge 23 slides during sharpening.

According to a variant embodiment (not shown), this stop may be in the form of a roller.

In the case of the variant embodiment of FIG. 4, the rear stop 44 should be mounted on a support moveable vertically jointly with the plate 32 and the jack 36 holding the grinding wheels.

As illustrated schematically in FIG. 5, each grinding wheel 34, 35 is in the form of a flattened cylinder and comprises a V-shaped groove 46 on its periphery. It is mounted so that its axis TT is inclined with respect to the horizontal. In this way, when the grinding wheel approaches blade 22, it comes into contact with the opposite sides 48, 50 on either side of the sharp edge 23 of the blade at two points B, B′ spaced apart vertically from the lateral edges of the groove.

The grinding wheel 34, 35 is made to comprise abrasive grains at least on the surface at the outer edges of the groove 46. To that end, either a grinding wheel may be made of a material containing abrasive grains in a binding agent, or a coating containing abrasive grains may be fixed by any appropriate method on the surface of a blank made of non-abrasive material.

By relative vertical movement of blade 22 and of grinding wheel 34, 35, the latter is driven in rotation and the abrasive grains exert on the blade a machining at the zones of contact along inclined paths with respect to edge 23, which effects sharpening.

The method of calculating allowing optimum dimensioning of the grinding wheel 34, 35 for a blade 22 of given dimensions, will now be set forth.

Figure 7:
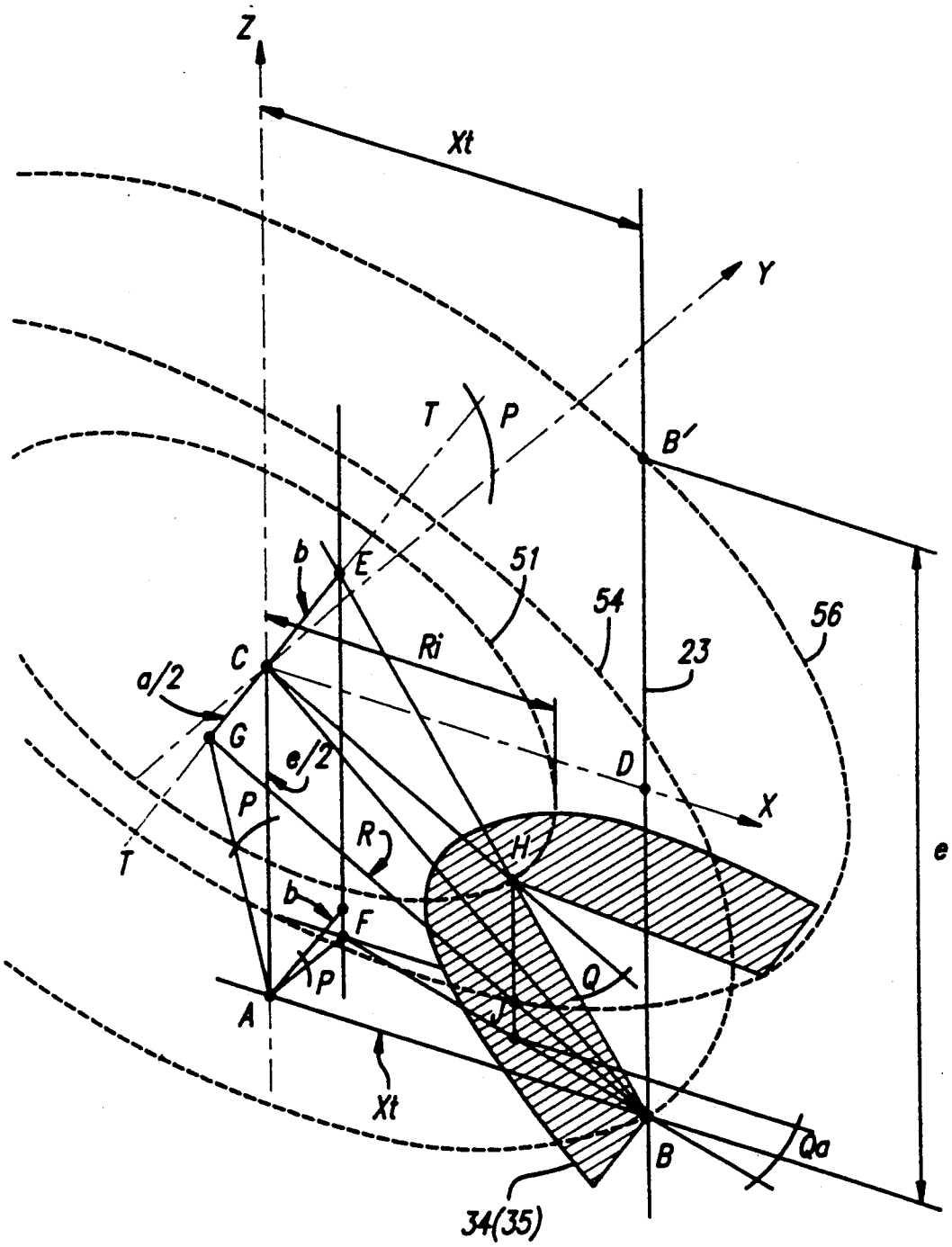
FIG. 7 is a schematic view in perspective illustrating the geometrical relations between the blade and the grinding wheel.

If reference is made to the schematic perspective view of FIG. 7, point C corresponds to the center of the grinding wheel; axis CX is the horizontal axis which intersects the circle of the bottom of groove 46 and the sharp edge 23 of the blade at a point D, axis CY is the horizontal axis perpendicular to the preceding one; axis CZ is the vertical axis passing through center C; the plane CXZ therefore representing the median plane of blade 22. Axis TT of the grinding wheel 34 is contained in plane CYZ and makes an angle P with axis CY.

The V-groove defines a circle 51 of groove bottom of radius Ri and two circular edges 54, 56 of radius R and distant by a distance a, the sharp edge 23 of blade 22 making contact with one and the other of the edges at two points B and B′ vertically distant by a distance e.

Point B projects on axis CZ at a point A distant from the center C by a distance e/2 and on axis TT at a point G distant from the center C by a distance a/2.

The frustum of the cone defining the groove wall on which lies point B has for its apex a point E on axis TT, at a distance b from center C.

This point E projects in a horizontal plane containing the straight line AB at a point F.

Point H is located at the intersection of the generatrix EB and of the circle 51 of groove bottom and point J is the projection of point H on segment BF.

Let Q designate the half-angle of aperture of the groove 46, Xt the horizontal distance between axis CA and the sharp edge 23 of the blade; Ri the radius of the circle 51 of the groove bottom; Qa the apparent half-angle of the groove 46 of the grinding wheel, seen vertically by blade 22; and N the half-angle of the cut of blade 22.

1—Relation between the dimensions of the grinding wheel:

According to the right-angled trapezium CGBH:

$$GB = CH + \frac{a}{2} \cdot \frac{1}{\text{Tan } Q}$$

2—Distance between the two points of contact of the sharp edge of the blade:

According to triangle ACG, $$CG/AC = \sin P$$

$$\text{viz. } a = e \sin P \qquad (2)$$

3—Distance between the blade edge and the vertical axis:

According to triangles ABC and BCG:

$$CB^2 32\ AB^2 30\ AC^2 32\ GB^2 + CG^2$$

$$\text{Viz. } Xt^2 30\ (e/2)^2 32\ (a/2)^2 30\ R^2$$

and, replacing a by e sin P according to relation (2):

$$Xt = [R^2 - (e/2 \cos P)^2]^{\frac{1}{2}} \qquad (3)$$

4—Apparent angle of the groove

According to triangle BGE, $$\text{i GE} = \text{GB} \tan Q$$

$$\text{viz. } a/2 + b = R \tan Q$$

or $$b = R \tan Q = a/2$$

In triangle ABF, $$Af = b \cos P$$

and $$\tan Qa = \frac{AF}{Xt} = \frac{b \cos P}{Xt}$$

Hence, by carrying the expression of b given by relation (3):

$$\tan Qa = (R \tan Q - a/2) \cos P/Xt \qquad (4)$$

5—Conditions to be fulfilled for correct functioning:

1) The half angle of the cut of the blade must be less than the apparent angle of the groove:

viz. $N<Qa$ (5)

2) The sharp edge of the blade must not be in contact with the bottom of the groove, viz. $Xt>Ri$ (6)

6—Numerical example:

Numerical values corresponding to a concrete case will be taken here.

Dimensions of the grinding wheels which are compatible with the available environment are firstly arbitrarily fixed. Thereafter, all the calculations are made with these values: as a function of the results obtained, certain values may be slightly amended and the calculation re-made until satisfactory values are obtained.

For the present example, the following values will thus be taken:

$N=15°$
$P=15°$
$e=24$ mm
$R=17$ mm

According to (2), the following is deduced:

$a=24\times\sin 15=6.2$ mm;
$a=6.2$ mm.

According to (3), Xt is calculated:

$Xt=12.4$ mm.

According to (5), $N<Qa$ or $\tan N<\tan Qa$.

The condition therefore becomes, using (4):

$$\tan N < \frac{(R \tan Q - a/2) \cos P}{Xt}$$

from which is extracted:

$$\tan Q > \frac{1}{R}\left(\frac{\tan N\, Xt}{\cos P} + \frac{a}{2}\right),$$

viz. $\tan Q > 0.384$ or $Q > 21°$.

According to (6), $Xt > Ri$.

According to (1), $Ri = R - \frac{a}{2 \tan Q}$ therefore $Xt > R - \frac{a}{2 \tan Q}$ or $\tan Q < \frac{a}{2(R - Xt)}$, hence $\tan Q < 0.674$ or $Q < 34°$.

Angle $Q$ is therefore limited by:

$21° < Q < 34°$.

In order to have a maximum duration of use of the blade, the difference $(Xt-Ri)$ should be as large as possible, which comes back to choosing Q closer to 21° than 34°.

$Q=22.5°$ for example.

$Ri=9.5$ mm may in that case be calculated.

The exact dimensions of the grinding wheel are then:

$R=17$ mm
$a=6.2$ mm
$Q=22.5°$
$Ri=9.5$ mm
$P=15°$.

During sharpening, blade 22 penetrates slightly in the groove 46 but the sharp edge 23 theoretically remains at distance Xt from axis CZ. In fact, as the edges of the groove 46 undergo slight wear, a slight decrease in this distance Xt is in practice observed as use proceeds, but this is not detrimental since values are chosen such that $Xt-Ri$ is as large as possible.

The advantage of disposing two or more grinding wheels in the sense of the sharp edge is that of allowing sharpening over a sufficient length while reducing the amplitude of the relative displacement of the blade.

These grinding wheels will be borne by an appropriate number of bifurcated supports.

Figure 8:
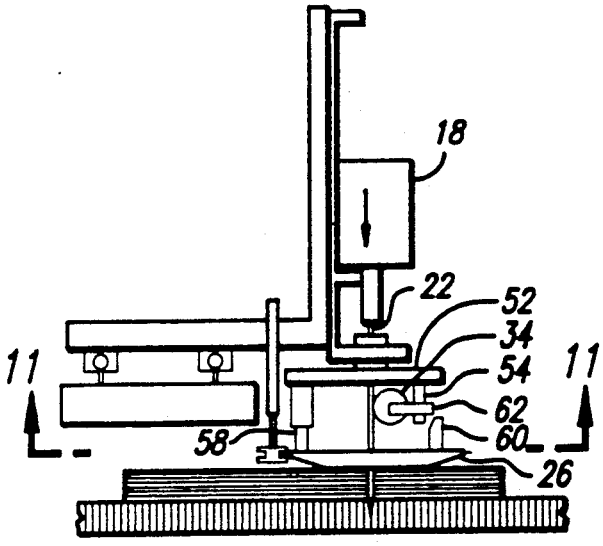
FIGS. 8, 9 and 10 show another embodiment of the device of the invention in which the grinding wheel is mounted to follow the rotation of the blade.
Figure 9:
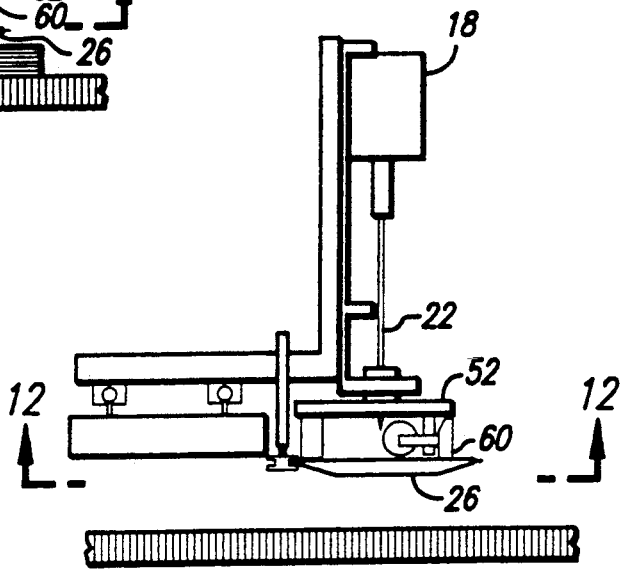
Figure 10:
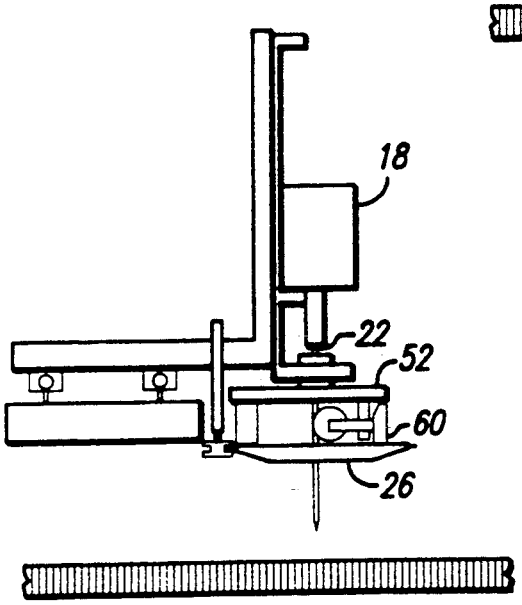
Figure 13:
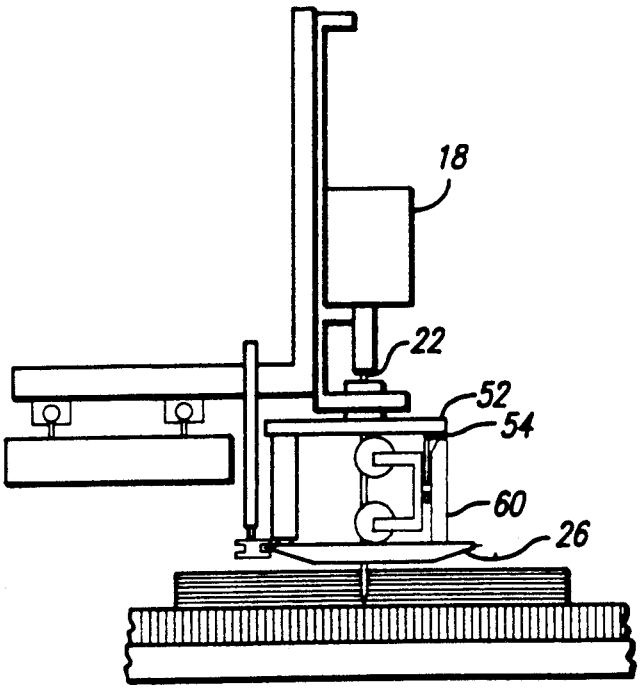
FIG. 13 shows an embodiment similar to FIGS. 8, 9 and 10 showing a bifurcated set of grinding wheels on a rotatable plate.

FIGS. 8 to 10 show another embodiment of the invention, in which the blade 22 is mounted for movement relative to the grinding wheel 34. FIG. 13 shows this embodiment with a bifurcated set of grinding wheels.

To that end, the grinding wheel 34 (or the grinding wheels mounted in series on the bifurcated support 38) is fixed on a guide plate 52 via a vertical support 54 and a horizontal spindle 62; in addition, this guide plate 52 presents a device for guiding the blade 22 and bears the presser foot 26 which may be actuated by means of a jack 58. The guide plate 52 is preferably rotatably mounted to the carriage 16 for free rotation about the axis of the cutting blade. During cutting, the guide plate 52 is animated by the same movement of rotation as the one imposed by means in the blade-holder unit 18 on the blade 22 and thus takes the sharpening system along in this movement. The groove of the grinding wheel 34 is therefore constantly opposite the sharp edge of the blade. In FIG. 9, just before sharpening, the jack 58 raises the presser foot 26 toward the guide plate 52, which forces the cam 60 to compress a return spring (not shown) located on or in the guide plate biasing the horizontal spindle 62 away from the blade, to force the horizontal spindle 62 and grinding wheel toward the cutting edge of the blade. In this way, the sharpening system is positioned correctly opposite the cutting edge of the blade. Sharpening may then take place in the position shown in FIG. 10.

Figure 11:
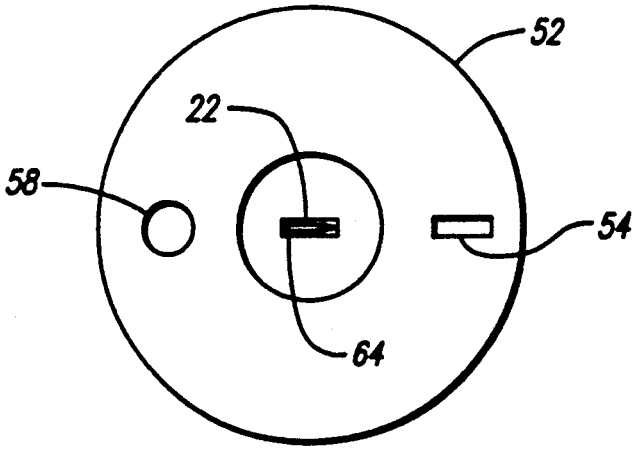
FIG. 11 is a cross-sectional view showing the bottom of the guide plate, taken along line 11—11 of FIG. 8.
Figure 12:
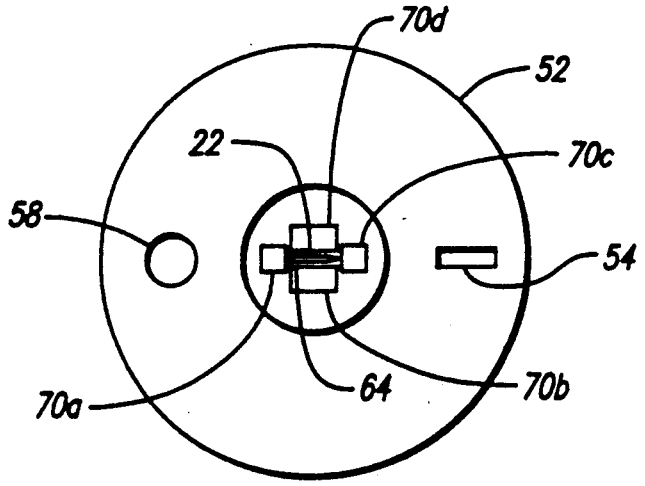
FIG. 12 is a cross-sectional view showing the bottom of an alternate embodiment of the guide plate, taken along line 12—12 of FIG. 9.

As is illustrated in FIG. 11, in one preferred embodiment, the guide plate 52 includes a central aperture 64 formed in a rectangular shape, with dimensions closely conforming to those of the blade 22 to provide guidance for the blade with a minimum clearance. Since guide plate 52 is freely rotatable, rotation of the blade causes the guide plate to rotate correspondingly, so that the grinding wheel assembly follows the edge of the blade to be sharpened. As is illustrated in FIG. 12, in order to avoid the effects of friction between the blade 22 and the guide plate 52, four wheels or rollers 70*abcd* may also be mounted to the guide plate 52 in a rectangular configuration, spaced apart from the blade with a minimum clearance corresponding to the shape and dimensioning of the guide plate aperture 64.

According to the embodiments shown in FIGS. 8–12, the sharpening process is as follows: blade 22 is placed in high position with its cutting edge facing the groove of the grinding wheel.

Grinding wheel 34 is automatically disposed by servo-control of the rotation of the grinding wheel by that of the blade as shown in FIG. 9.

Blade 22 is then vibrated exactly in the same manner as during cutting; grinding wheel 34 is then brought, in a horizontal movement, in contact with the blade, and is maintained in this arrangement for a very short time.

Finally, after having released the grinding wheel 34, the cutting process may be resumed without it being necessary to stop the vibration of the blade 22.

Since sharpening is effected according to this method with the blade in a high position, advantage may therefore be taken of the idle times of cutting (for example during the displacement between two pieces), where the blade is necessarily in a high position to effect sharpening. Sharpening is thus in "masked time", which avoids losses of time and optimalizes the speed of the machine.

The relative displacement of the blade 22 and of the grinding wheel 34 is, according to this method, directly connected with the amplitude of longitudinal vibration of the blade; this datum must therefore be taken into account in the calculation of the optimum dimensioning of the system. The other operational parameters set forth in the general presentation naturally remain applicable.

Let W be the amplitude of longitudinal vibration of the blade. Each point of contact (B and B') sharpens on either side of the blade a length equal to W. As an "overlapping" of the two sharpened zones is desired, the following condition must be respected:

$$e<W$$

It will suffice to take for example an "overlapping" of 1 mm:

$$e=W-1 \text{ (1) } (e \text{ and } W \text{ in mm})$$

The cutting parameters set:

W=25 mm

N=15°

In that case, e=24 mm (the value used previously during the numerical application made within the framework of the general method).

Another parameter intervening in the dimensioning and configuration of the system is the length of the sharpened blade. Let L be the length of sharpened blade. Since there is an "overlapping", $$L=e+W$$

Knowing that e depends only on the dimensions and inclination of the grinding wheel which may be chosen, e may be adjusted as a function of the blade length which it is desired to sharpen, as long as this length remains less than 2 W, since e must not exceed W. If, on the other hand, L exceeds 2 W, it is provided to place in series a number n of grinding wheels with the result that the length of the sharpened blade reaches the desired value. The distance between two successive grinding wheels is such that the "overlapping" of two zones sharpened by different grinding wheels is equal to the "overlapping" of two zones sharpened by the same grinding wheel. The total length of sharpened blade is then given by the formula:

$$L=(2n-1)e+W$$

Again, the parameter e may be adapted so as to obtain the desired length of the sharpened blade.

It will be apparent from the foregoing that while particular forms of the invention have been illustrated and described, various modifications can be made without departing from the spirit and scope of the invention. Accordingly, it is not intended that the invention be limited, except as by the appended claims.

What is claimed is:

1. A device for sharpening an elongated cutting blade presenting a sharp edge, comprising a grinding wheel provided on a surface thereof with abrasive material, said grinding wheel having a cylindrical body presenting a V-sectioned peripheral groove, wherein said abrasive material covers at least a portion of said V-shaped groove, said grinding wheel being supported by a carriage and mounted to rotate freely about an axis contained in a first plane generally parallel to the sharp edge of the blade and perpendicular to a median plane of the blade, and said axis being inclined relative to a second plane perpendicular to said first plane and to the median plane of the blade, said sharpening device comprising means for placing the blade and said portion of the V-shaped groove of the grinding wheel in contact and means for relative displacement of one of the blade and the grinding wheel in a linear direction parallel to and in line with the sharp edge of the blade for sharpening said sharp edge of the blade;

wherein said axis of said grinding wheel is fixed relative to said linear direction, and the means for relative displacement between the blade and the grinding wheel includes a means for displacing the blade in said linear direction; and wherein a blade-holder unit is provided with means to rotationally orient said blade and means to drive the blade-holder unit in said linear direction, and the axis of the grinding wheel is fixed relative to said linear direction by means of a vertical support and a horizontal spindle on a plate rotatably supported by said carriage, said plate having a guide for guiding said blade and for rotating said plate with the blade, such that said V-shaped groove of said grinding wheel is maintained in a position facing the sharp edge of the blade.

2. The device of claim 1, wherein a rear stop is provided adjacent a side of the blade opposite said grinding wheel, so as to limit bending of the blade when the blade contacts the grinding wheels.

3. A process for sharpening an elongated cutting blade rotatably supported by a blade-holder unit, said blade presenting a sharp edge which is rotated about a longitudinal axis of the blade and moved in a longitudinal direction along its longitudinal axis opposite a sharpening device comprising a plate including a guide for said blade, said plate supporting a grinding wheel, said grinding wheel being provided at least on a surface with abrasive material and having a cylindrical body presenting a V-section peripheral groove, wherein said abrasive material covers at least a portion of said V-shaped groove, said grinding wheel being mounted to rotate freely along with said longitudinal movement of said blade, and said grinding wheel being mounted to rotate about an axis inclined by a predetermined angle with respect to the normal to a median plane of the blade, said process comprising the following steps of:

rotating the plate supporting the grinding wheel by rotating the blade;

bringing said portion of said grinding wheel into contact with the sharp edge of the blade;

moving one of said blade and said grinding wheel in said longitudinal direction to sharpen the blade; and preventing the blade from bending when it contacts the grinding wheel.

4. The process of claim 3, wherein the blade is moved relative to the grinding wheel by vibrating the blade in said longitudinal direction in line with the sharp edge of the blade.

5. The process of claim 3, wherein the blade is moved relative to the grinding wheel by vertically displacing the blade-holder unit relative to the grinding wheel.

6. A device for sharpening an elongated cutting blade presenting a sharp edge, comprising at least two grinding wheels each provided at least on a surface thereof with abrasive material, each grinding wheel having a cylindrical body presenting a V-sectioned peripheral groove, wherein said abrasive material covers at least a portion of said V-shaped groove, said grinding wheel being supported by a carriage and mounted to rotate freely about an axis contained in a first plane generally parallel to the sharp edge of the blade and perpendicular to a median plane of the blade, and said axes being inclined relative to a second plane perpendicular to said first plane and to the median plane of the blade, said sharpening device comprising means for placing the blade and said portion of the V-shaped groove of the grinding wheels in contact and means for relative displacement of the blade and the grinding wheels in a linear direction parallel to and in line with the sharp edge of the blade, said grinding wheels being juxtaposed along said linear direction of the sharp edge of the blade and borne by at least one bifurcated support such that an amplitude of the relative displacement of the blade necessary for sharpening a predetermined length of the blade is thereby correspondingly reduced according to the number of said grinding wheels provided.

7. The device of claim 6 wherein said axes of said grinding wheels are fixed relative to said linear direction, and the means for relative displacement between the blade and the grinding wheels include a means for displacing the blade in said linear direction.

8. The device of claim 6, wherein a rear stop is provided adjacent a side of the blade opposite said grinding wheels, so as to limit bending of the blade when the blade contacts the grinding wheels.

9. The device of claim 6 wherein a blade-holder unit is provided with means to rotationally orient said blade and means to drive the blade-holder unit in said linear direction, and the axes of each said grinding wheel is fixed relative to said linear direction by means of a vertical support and a horizontal spindle on a plate rotatably supported by said carriage, said plate having a guide for guiding said blade and for rotation of said plate with the blade, such that the V-shaped groove of each of said grinding wheels is maintained in a position facing the sharp edge of the blade.

* * * * *